US009290188B2

(12) United States Patent
Schwiegel et al.

(10) Patent No.: US 9,290,188 B2
(45) Date of Patent: Mar. 22, 2016

(54) CARRIAGE BODY FOR A RAILROAD VEHICLE WITH A COUPLING FIXING DEVICE AND METHOD FOR PRODUCING SAID CARRIAGE BODY

(75) Inventors: Thomas Schwiegel, Niederlehme (DE); Torsten Sohn, Bradenburg (DE); Christian Galle, Wulkow (DE); Georg Kussatz, Berlin (DE)

(73) Assignee: Bombardier Transportation GmbH, Berlin (DE)

( * ) Notice: Subject to any disclaimer, the term of this patent is extended or adjusted under 35 U.S.C. 154(b) by 254 days.

(21) Appl. No.: 13/823,343

(22) PCT Filed: Sep. 20, 2010

(86) PCT No.: PCT/EP2010/005835
§ 371 (c)(1),
(2), (4) Date: May 29, 2013

(87) PCT Pub. No.: WO2012/037952
PCT Pub. Date: Mar. 29, 2012

(65) Prior Publication Data

US 2013/0319281 A1 Dec. 5, 2013

(51) Int. Cl.
*B61G 7/10* (2006.01)
*B61G 9/22* (2006.01)
*B61F 1/10* (2006.01)

(52) U.S. Cl.
CPC ... *B61G 7/10* (2013.01); *B61F 1/10* (2013.01); *B61G 9/22* (2013.01); *Y10T 29/49622* (2015.01)

(58) Field of Classification Search
CPC ..... B61G 7/10; B61G 9/22; B61F 1/10
USPC ..... 105/414, 420, 421
See application file for complete search history.

(56) References Cited

U.S. PATENT DOCUMENTS

| | | | | |
|---|---|---|---|---|
| 3,329,285 | A * | 7/1967 | Crenshaw | 213/8 |
| 3,339,501 | A | 9/1967 | Gutridge | |
| 3,954,066 | A * | 5/1976 | Heap | 105/416 |
| 3,973,681 | A * | 8/1976 | Martin et al. | 213/8 |
| 4,782,762 | A * | 11/1988 | Johnstone et al. | 105/355 |
| 7,350,842 | B2 * | 4/2008 | LeBlanc et al. | 296/43 |
| 7,410,069 | B2 * | 8/2008 | Hogbring et al. | 213/50 |

FOREIGN PATENT DOCUMENTS

| | | | |
|---|---|---|---|
| DE | 10129420 | A1 | 1/2003 |
| EP | 1125816 | A1 | 8/2001 |
| EP | 2130739 | A1 | 12/2009 |
| WO | 02102638 | A1 | 12/2002 |
| WO | 2009115198 | A1 | 9/2009 |

* cited by examiner

*Primary Examiner* — Zachary Kuhfuss
(74) *Attorney, Agent, or Firm* — The Webb Law Firm

(57) ABSTRACT

A carriage body for a railroad vehicle, said carriage body having the following: a base, two lateral walls, each of which is connected to the base, at least two longitudinal supports, each of which lies in the transitional region of the base to the lateral wall on opposing sides of the carriage body and which extend in the longitudinal direction of the carriage body, and a coupling fixing device for fixing a coupling via which the carriage body can be connected to a carriage body of another carriage. The fixing device is arranged below the base, and a lower face of the fixing device is connected directly to the longitudinal supports via a connection.

23 Claims, 7 Drawing Sheets

32
8
34
29
35b
36b
20
6b
30
19b
18b
25b
26b
31
17b
44b
42
41
40
27
37
3
44a
17a
26a
36a
6a
25a
35a
19a
18a
34a 54
68b
68a
58a
88
74b
74a
72b
72a
17a
79c
69c
89
101
105a
53
71
73
67b
6a
77b
87
77a
67a
105b
79b
79a
69b
69a
17a
89

CARRIAGE BODY FOR A RAILROAD VEHICLE WITH A COUPLING FIXING DEVICE AND METHOD FOR PRODUCING SAID CARRIAGE BODY

BACKGROUND OF THE INVENTION

The invention relates to a carriage body for a railroad vehicle. The carriage body is preferably constructed in an integral manner, i.e., at least a base plate, lateral walls, a roof element, and end walls are joined together, and is constructed in particular of aluminum extrusion press elements welded to one another, which are configured in a standard manner as double-walled hollow chamber profiles, in particular profiles with opposing sheet metal walls connected to one another with bridges. The bridges or partitions delimit air chambers running in the longitudinal direction of the profile. However, not all of the aforesaid parts of the carriage body have to be produced from extrusion press structures. Instead it is also possible for only certain areas of the carriage body to be produced from extrusion press profiles. In trains that have several carriages, the carriages are hooked up to one another by couplings, in particular so-called central buffer couplings. The couplings transfer the traction and thrust forces in the longitudinal direction of the carriage body and thus in the direction of travel of the train. Underneath the base of the carriage body, the carriage body of the invention has a coupling fixing device (e.g., a coupling plate) for fixing a coupling by which the carriage can be hooked up to other carriages of a train. The invention further relates to a method for producing such a carriage body and a railroad vehicle with such a carriage body.

The coupling plate has a side facing the end of the carriage body in the longitudinal direction of the carriage body or a space open toward this side, on which side or in which space the coupling is or can be fixed, for example by means of a flange on a surface of the coupling plate. In lieu of a coupling plate, provision can be made of another device on which the coupling is fixed or can be fixed and via which forces acting particularly in the longitudinal direction of the carriage body are transferred between the coupling and the device. For example, the device can have an arrangement of struts and a fixing element. The coupling is fastened onto the fixing element and the struts extend in different directions within a plane running perpendicular to the lengthwise axis of the carriage body. The struts hold the fixing element against a frame that forms the outer edge of the device. The device can be designated in a general manner as a coupling fixing device. The fixing element or other configuration of the fixing device can have, for example, a block of material with a hollow space open on one side in which the end of the coupling is or can be inserted. The block of material can have, for example, two parts which each border a portion of the hollow space. The parts can be fixed to one another such that the end of the coupling cannot be removed from the hollow space without first disengaging the mechanism fixing the parts.

The carriage body can in particular be a carriage body for a trolley, a local train, an intercity train, or a high velocity train.

EP 2130739 A1 discloses a carriage body for a railroad vehicle that has two end modules. The coupling by which the carriage body can be hooked up to adjacent carriage bodies has an inside end that is connected directly to a transverse element of a substructure or to a cross tie for transferring longitudinal forces. The substructure has a pair of longitudinal supports that extend out from the transverse element in the longitudinal direction of the coupling. The longitudinal supports end at a frame that is connected to the underside of the carriage body. On its lower face, the end module also has a frame having, on its end side facing the adjacent carriage, a window through which the coupling extends to the fixation zone on the end of the frame. The frame has a set of longitudinal supports and additional elements running lengthwise. In the fixation zone of the coupling, the frame has a plate-shaped inner underbeam.

DE 10129420 A1 describes a head structure for the shells of railroad vehicles. The head structure has a base plate, a head panel (i.e., a coupling plate), a longitudinal brace extending in a longitudinal direction of the carriage body, as well as a plurality of local stiffening elements in the nature of transverse supports. The base plate is connected to the base plate of a carriage body by a main transverse support. In addition to the longitudinal brace provided in the area of the base plate, additional (e.g., diagonal) brace elements are possible, which can essentially support the actual head panel over its entire height.

For receiving forces (henceforth also known as coupling forces) transferred via the coupling to the carriage body or vice versa, so-called coupling boxes have also been proposed, which are fixed beneath the base of the carriage body. As with the frame according to EP 2130739 A1, the coupling extends through a front opening of the coupling box to the back end of the coupling box and is fixed on the back side of said coupling box, e.g., by means of a flange. The coupling box has lateral walls extending in the longitudinal direction and a base. The lateral walls as well as the front and rear walls of the coupling box can be connected on their upper face to a plate-shaped reinforcement of the carriage body base. Furthermore, the coupling forces introduced by the coupling into the back end of the coupling box via various brace elements, in particular at least one cross strut, a lengthwise strut, and optionally also diagonal struts, are transmitted to the base of the carriage body. Additional reinforcements may be needed on the places where the forces are introduced into the base of the carriage body, depending on the strength of the base.

As these examples show, the purpose of the coupling fixing device (e.g., the coupling plate) on which the coupling is or can be fixed is to receive the forces exerted on the carriage body by the coupling and, conversely, to exert forces from the carriage body on the coupling. The forces are transferred essentially in the longitudinal direction of the carriage body and thus the train, although transverse forces acting perpendicular to the longitudinal axis are also generated. In order that these forces may be transferred between the coupling fixing device and the carriage body, the coupling fixing device (e.g., coupling plate) is connected to the base of the carriage body via the aforementioned force transfer elements, specifically longitudinal braces, transverse supports, stiffening elements, and diagonal struts. These force transfer elements secure the coupling fixing device and distribute the forces introduced into the base of the carriage body by the coupling fixing device. The forces are then transferred from the base, in particular the base plate of an integrally constructed carriage body, to the longitudinal supports in the zone of the transition between the base and the lateral walls. In the case of a base plate, said base plate is typically connected to the longitudinal supports over the entire length of the carriage body. However, the longitudinal supports do not have to be configured as separate components. For example, they can be an integral part of the base instead.

In order to secure the coupling fixing device, in particular the coupling plate, in a stable manner and enable the transfer of forces between the carriage body and the coupling, it is known that a plurality of force transfer elements is required, wherein the latter must be configured with sufficient stability so as not to collapse nor undergo any substantial deformation under the greatest possible stress, not even in the event of lightweight construction as is the case with aluminum extrusion press profiles with air chambers. If the force transfer elements have a substantial weight, correspondingly greater amounts of material and room underneath the base of the carriage body are required. This room would then be unavailable for, say, a carriage bogie, electric cables and/or hydraulic or pneumatic lines. Since the coupling fixing device is arranged in the end region (when viewed in the longitudinal direction of the carriage body) of the carriage, the bogie must be a considerable distance away from the end of the carriage or of the carriage body.

SUMMARY OF THE INVENTION

An object of the present invention is to propose a carriage body and a suitable production method that make it possible to reduce the number and/or weight of the force transfer elements required for transferring forces between the coupling fixing device and the carriage body and simultaneously reduce the amount of installation space required.

Connecting the coupling fixing device (e.g., the coupling plate) on its lower face directly to longitudinal supports extending in the lengthwise axis of the carriage body on opposing sides of said carriage body is proposed, the purpose of said connection being to transfer forces directly between the longitudinal supports and the coupling fixing device. The connection is thus a component that is essential for the statics of the carriage body and for the dynamic force transfer and not merely a cladding of the underside.

In particular a carriage body for a railroad vehicle is proposed, wherein the carriage body has the following:

a base, two lateral walls, which are each connected to the base, at least two longitudinal supports, which are arranged on opposing sides of the carriage body in each transitional region of the base to the lateral wall and extend in the longitudinal direction of the carriage body, a coupling fixing device for fixing a coupling by which the carriage body can be hooked up to the carriage body of another carriage, wherein the fixing device is arranged underneath the base and wherein a lower face of the fixing device is joined directly to the longitudinal supports via a connection.

The connection is configured such that a gap is left between the base of the carriage body and the connection, i.e., the connection has a U profile when viewed in a cross-sectional plane extending transversely to the longitudinal direction of the carriage body. Preference is given to a continuous connection of the lower face of the coupling fixing device to the longitudinal supports on the opposing sides of the carriage body such that, in a cross-section perpendicular to the longitudinal direction of the carriage body, a trough-shaped profile is formed, the interior of the trough lying below the base of the carriage body. Expressed another way, "continuous" means that the connection of the one longitudinal support to the other longitudinal support on the opposing side of the carriage body via the lower face of the coupling fixing device is uninterrupted.

If the coupling fixing device is a coupling plate, the latter can be a multi-part, in particular a two-part element so that the plate is easier to handle when fixing to other parts.

The connection is in particular achievable by at least one plate-shaped part, wherein the opposing surfaces of the plate-shaped part extend toward the connection and approximately in the longitudinal direction of the carriage body. In the case of the U profile configuration (see above), a trough is formed that extends in the longitudinal direction of the carriage body and has in each case a U profile of the aforementioned nature over a section in the longitudinal direction of the carriage body. The connection can in particular extend over a longitudinal section of the carriage body, wherein the connection is joined in at least in one, preferably in two places to the base by a brace element running from bottom to top to the base of the carriage body. Said preferably two brace elements are preferably spaced apart from one another in a horizontal direction running transversely to the longitudinal direction of the carriage body, the separation zone defining the space through which the coupling extends from the end of the carriage body to the coupling fixing device. The two brace elements spaced apart from one another thus form a coupling box of the aforementioned type conjointly with the coupling fixing device and the carriage body base. Hence the connection of the lower face of the coupling fixing device to the longitudinal supports can form the base of the coupling box.

On the upper face of the coupling fixing device or in the special case, on the upper face of the coupling box, in addition to the base there can be a reinforcement plate, in particular a reinforcement plate by which the coupling fixing device and/or (if present) the brace elements are indirectly connected to the base of the carriage body. A difference between the base of the carriage body and such a reinforcement plate should especially be noted if the base is formed by a base plate made of extrusion press profiles. The reinforcement plate introduces the forces to be exerted on the base by the coupling fixing device into a large region in the base, i.e., it distributes the forces. Especially if the base is formed by at least one extrusion press profile having bridges between two sheet metal cover elements forming the outer surfaces, the cover elements can be so thin that an introduction of forces into a small region would not be sufficiently stable. In this case in particular the reinforcement plate also facilitates the achievement of a stable welded joint on the upper face of the coupling fixing device. With a greater material thickness of the reinforcement plate in comparison to the cover element, the welded joint becomes more stable and is more easily achieved, since the thermal properties of the reinforcement plate can be adapted to the coupling fixing device.

Preference is given to the connection between the lower face of the coupling fixing device and the longitudinal supports extending over a longitudinal section in the area of the longitudinal supports, which section runs in the longitudinal direction of the carriage body. Preference is given to the longitudinal section being longer than the longitudinal extension of the connection in the area of the coupling fixing device. Preference is given to the connection being joined in a continuous manner to the longitudinal support over the longitudinal section. The advantage of this configuration is that it provides additional stability to the carriage body. It also makes it easier to provide, for example, door openings or other openings in the lateral walls of the carriage body in the vicinity of the longitudinal section. Expensive additional reinforcement means for compensating the weakening of the mechanical stability of the carriage body in the area of the openings can be dispensed with or at least reduced.

The coupling fixing device is optionally supported on its side opposing the side of the end of the carriage body by at least one plate-shaped element on the lower face of the base of the carriage body. Preference is given to the plate-shaped element having a lower edge that does not extend parallel to the upper edge of the plate-shaped element along its entire length. In comparison to a rectangular plate-shaped element, the lower edge can instead be created by, for example, omitting or cutting off a part of the rectangle. In a preferred manner, the shape of the lower edge can be concave such that space is formed in the concave area that can be used, e.g., for parts of a bogie.

Preference is given to the presence of two plate-shaped elements of the same shape, wherein said plate-shaped elements are spaced apart from one another in a horizontal direction running transversely to the longitudinal direction of the carriage body. When viewing a horizontal cross-section below the base of the carriage body, the two plate-shaped elements spaced apart from one another, the coupling fixing device configured as, e.g., a coupling plate, and the two optionally present brace elements holding the aforementioned connection on the base of the carriage body form an H profile, wherein the two legs of the H do not have to be parallel over their entire height. For example, the sections of the legs of the H formed by the two brace elements can diverge when viewed from the coupling plate.

Regardless of the actual configuration and arrangement of the force transfer elements that transfer coupling forces between the coupling fixing device and the base of the carriage body, the connection between the lower face of the coupling fixing device and the longitudinal supports on opposing sides of the carriage body as described above has the advantage of enabling the direct transfer of forces between the longitudinal supports and the lower end of the coupling fixing device. When mention is made of the lower face of the coupling fixing device in this description, the possibility of the lower end of the coupling fixing device lying somewhat below the connection to the opposing longitudinal supports is not ruled out. However, preference is given to positioning the connection at the lower end of the coupling fixing device.

The direct transfer between the opposing longitudinal supports and the lower face of the coupling fixing device gives rise to a stable construction, which makes it possible to omit force transfer elements known from prior art embodiments of carriage bodies, in particular diagonal struts and transverse struts. This creates space for the installation of cables and hydraulic or pneumatic lines.

Moreover, because a direct transfer of forces from the lower face of the coupling fixing device into the opposing longitudinal supports and vice versa is able to occur, the optionally additional force transfer elements for securing the coupling fixing device can be made smaller and lighter. Furthermore, less space is required for the force transfer elements, especially in the middle region underneath the base of the carriage body. It is thus furthermore possible to arrange the coupling fixing device closer to the end of the carriage body (when viewed in the longitudinal direction thereof). Hence a bogie can be arranged closer the end of the carriage body.

Furthermore, the expense for installing the coupling fixing device is reduced, since fewer parts are needed and since the connection to the longitudinal supports at a distance from the carriage body base and laterally to the longitudinal supports rather than directly beneath the carriage body base in the middle region thereof is easily achievable.

Preference is given to achieving the connection of the lower face of the coupling fixing device to the opposing longitudinal supports with a plurality of plate-shaped individual parts, wherein the individual parts are preferably each extrusion press profiles and wherein longitudinal axes of air chambers and thus partitions between the air chambers in the extrusion press profiles extend in the longitudinal direction of the carriage body. However, it is also conceivable for the longitudinal direction of the air chambers and thus the partitions between the air chambers to extend transversely to the longitudinal direction of the carriage body in at least a portion of the plate-shaped individual parts.

Preference is given to welding these individual parts to one another. Further preference is given to the individual parts being made of aluminum.

Although at least two of the individual parts can be designed as plate-shaped, i.e., as having two opposing outer surfaces running approximately parallel to one another, the outer surfaces, however, do not extend in a plane but are curved. These individual parts or, in the case of a continuous connection not produced from individual parts, curved regions of the connection are preferably located laterally to and somewhat below the opposing longitudinal supports of the carriage body or slightly offset in relation to the lengthwise axis of the carriage body. The curved individual parts or curved regions form a transition between a region of the connection running essentially in the horizontal direction and a region of the connection that extends from the bottom to the top to the respective longitudinal support. Alternatively, the curved individual part or the curved region can lead directly to the longitudinal support. The curved individual part or the curved region can in addition be used as part of the cladding of the carriage body. It is thus possible to dispense with or at least reduce the number of additional parts for the cladding.

The connection of the lower face of the coupling plate up to the opposing longitudinal supports can start at the end of the carriage body (viewed in the longitudinal direction of the carriage body). As already mentioned, the connection can thus form a part of the outer contour of the carriage body, specifically a part of the outer contour located underneath the base of carriage body from the viewpoint of the end face of the carriage body. The space between the connection and the base of the carriage body can thus be at least partially closed. However, at least one opening must be left in order to be able to operate the coupling to be connected to the coupling fixing device. This end face covering of the space optionally has at least another opening for allowing an inflow of the airstream generated by the moving vehicle. This airflow can be used, for example, to cool parts and mechanisms underneath the carriage body base as the vehicle is moving. For example, in this manner it is possible to cool a drive engine installed on the bogie arranged behind the coupling fixing device and driving the wheels of the bogie. Such other openings can also be used for through cables and hydraulic or pneumatic lines.

As already mentioned, the connection between the lower face of the coupling fixing device and the opposing longitudinal supports enables a direct transfer of forces between the longitudinal supports and the lower end of the coupling fixing device. Additionally, as also already mentioned and known as such from the prior art, the coupling fixing device (e.g., coupling plate) is joined directly or indirectly to the base of the carriage body such that forces can also be transferred between the base and the coupling fixing device. The entire arrangement of the coupling fixing device and all of the force transfer elements is in particular configured such that more than 10% and preferably more than 50% (e.g., 60%) of a longitudinal force exerted by the coupling on the middle of the coupling fixing device in the longitudinal direction of the carriage body is transferred directly via the connection from the lower face to the opposing longitudinal supports. Less than 90% and preferably less than 50% (e.g., 40%) of the longitudinal force is therefore transferred directly from the coupling fixing device via the other force transfer elements or directly from the coupling fixing device to the carriage body base. It is thus possible to configure these other force transfer elements especially lightweight and/or in a smaller number and/or with less installation space.

Another aspect of the invention relates to the fixing of the coupling fixing device configured as a coupling plate to the connection and/or to the base of the carriage body (e.g., directly to the base plate of the carriage body or indirectly via at least one other element). In the case where the coupling plate is fixed directly to the base of the carriage body, this aspect is also achievable as such, i.e., no connection of the lower face of the coupling plate to the opposing longitudinal supports of the carriage body is needed. All other features such as the above described brace elements, the at least one plate-shaped element, the configuration of the coupling fixing device designed in particular as a coupling plate with angled regions, and/or the other configuration of the above described and still to be described coupling box are achieved or can be achieved even in the absence of a connection of the lower face of the coupling plate to the opposing longitudinal supports of the carriage body. However, in this case preference is given to the height of the coupling fixing device, in particular of the coupling box (the height is viewed in the vertical direction) is less than in the case where there is a connection of the lower face of the coupling fixing device to the opposing longitudinal supports.

The coupling plate must be fixed in a stable manner on its respective end (the upper end, which is to be connected to the base of the carriage base, and/or the lower end, which is optionally to be joined to the connection). According to this other aspect of the invention, the coupling plate should have a continuous surface (and in particular not a surface interrupted by numerous hollow spaces, as would be the case with an extrusion press profile) on the end being fixed and this surface should have a receding region arranged between opposing edge regions of the surface. The coupling plate can in particular be configured as a solid element, i.e., without the air chambers of an extrusion press profile. If the end with this surface is brought in abutment with a level surface (e.g., with the base plate of the carriage body or with a surface of the connection to the opposing longitudinal supports), the edge regions of the surface then lie essentially flat on the level surface, whereas the receding region forms a hollow space conjointly with the level surface. This arrangement makes it possible to join, in particular to weld, the edge regions of the surface to the level surface. The purpose of this configuration with the receding region of the surface is to enable the adaption of the thermal properties of the coupling plate to the thermal properties of the material forming the level surface. If the parts to be joined together to produce a welded joint (or other joint connection that requires heating the parts) are heated, the heating of the part forming the level surface could lead to premature melting and thus flowing of the material, whereas the material of the coupling plate is not yet sufficiently heated. Owing to the narrower edge regions of the surface and the receding region between them, however, the material at the edge regions of the surface of the coupling plate can be brought more or less simultaneously to the same temperature required for the joining process. In addition the hollow space bordered by the receding region and the level surface can receive filler material used to produce the joint connection, such as solder or filler material used in welding.

According to another concept, the coupling plate has on each of its lateral ends (i.e., when viewed in a horizontal cross-sectional plane at the ends in proximity to the opposing longitudinal supports of the carriage body) at least one angled region such that, also when viewed in a horizontal cross-sectional plane, the coupling plate forms a U-shaped profile or (when the lateral ends are angled on both sides) an H-shaped profile. The purpose of the angled region is to connect the coupling plate in this region to an additional force transfer element via which forces are transferred between the base of the carriage body and the coupling plate. Examples of such force transfer elements have been described above. The angled regions of the coupling plate make it possible to produce a joint connection, which requires a heating of the parts to be joined together, between the coupling plate and the other force transfer element, wherein the angled region of the coupling plate is adapted to the thermal properties of the other force transfer element. Examples and embodiments will be discussed in more detail.

Especially on its lateral ends, but also on the edges of the parts of the coupling plate to be joined together in multi-part configurations, the coupling plate can be configured such that the ends have two bridge-shaped protruding regions at which the ends are welded to another part. At least one of the protruding regions has an angled edge that forms conjointly with a similarly angled edge of the part to be welded on a V-shaped or Y-shaped recess extending in the longitudinal direction of the protruding region. The recess is open to the outside, i.e., if the two protruding regions have the angled edge, then the openings of the recesses point away from one another.

Preference is also given to the formation of a tongue-shaped end region on the protruding region with the angled edge, which protrudes furthest toward the part to be welded on. This tongue-shaped end region can be arranged in a recess of an end region of the part to be welded on prior to producing the welded joint. Further preference is given to the tongue-shaped end region having on its outer side, oriented toward the angled edge region, a recess serving as a so-called weld pool backing. An example of a weld pool backing is described in WO 2009/115198 A1. The recess prevents the welded joint from being produced over the entire tongue-shaped region and receives material liquefied during the welding process.

The scope of the invention includes a corresponding production method for producing a carriage body. The method has the following steps in particular:

Provision of a carriage body base,

Provision of two lateral walls,

Arrangement and/or configuration of at least one longitudinal support in the transitional region of the base to each lateral wall, wherein the longitudinal supports extend in a longitudinal direction of the carriage body, Provision of a coupling fixing device for fixing a coupling via which the carriage body can be hooked up to a carriage body of another carriage, wherein the fixing device is arranged underneath the base, Fixing of a lower face of the fixing device directly to the longitudinal supports via a connection, Connection of each lateral wall to the base.

The aforementioned steps do not need (or do not all need) to be performed in this sequence. The preceding listing is therefore not a sequence for performing the steps. Obviously the longitudinal supports, the coupling fixing device, and the connection must be present initially so that they can be joined to one another. However, it is possible, for instance, to connect the base to the longitudinal supports and optionally to the coupling fixing device or to produce the base after the longitudinal supports and the coupling fixing device have already been joined to one another via the connection. Nor is it compulsory for the lateral walls to be connected afterwards to the base via the longitudinal supports, although it is preferable to do so. Alternatively, this step can be performed prior to the connection of the longitudinal supports to the coupling fixing device. However, in every case mention may be made of a transitional region between the base and the lateral walls, since the assembly as a whole is predetermined. Also, not all of the parts have to be provided at the start, but can instead be provided when they are needed.

Embodiments of the method will emerge from the description of embodiments of the carriage body.

The connection can in particular be produced from aluminum extrusion press box profiles that are welded to one another. As part of a preassembly, the connection can be produced initially and the connection is then joined, in particular welded to the coupling fixing device and to the opposing sides of the carriage body in the region of the longitudinal supports.

BRIEF DESCRIPTION OF THE DRAWINGS

Illustrative embodiments of the invention shall now be described with reference to the appended drawing. The individual figures show.

[Note: the letter reference signs are derived from the original German terms.]

DETAILED DESCRIPTION OF THE INVENTION

Figure 1:
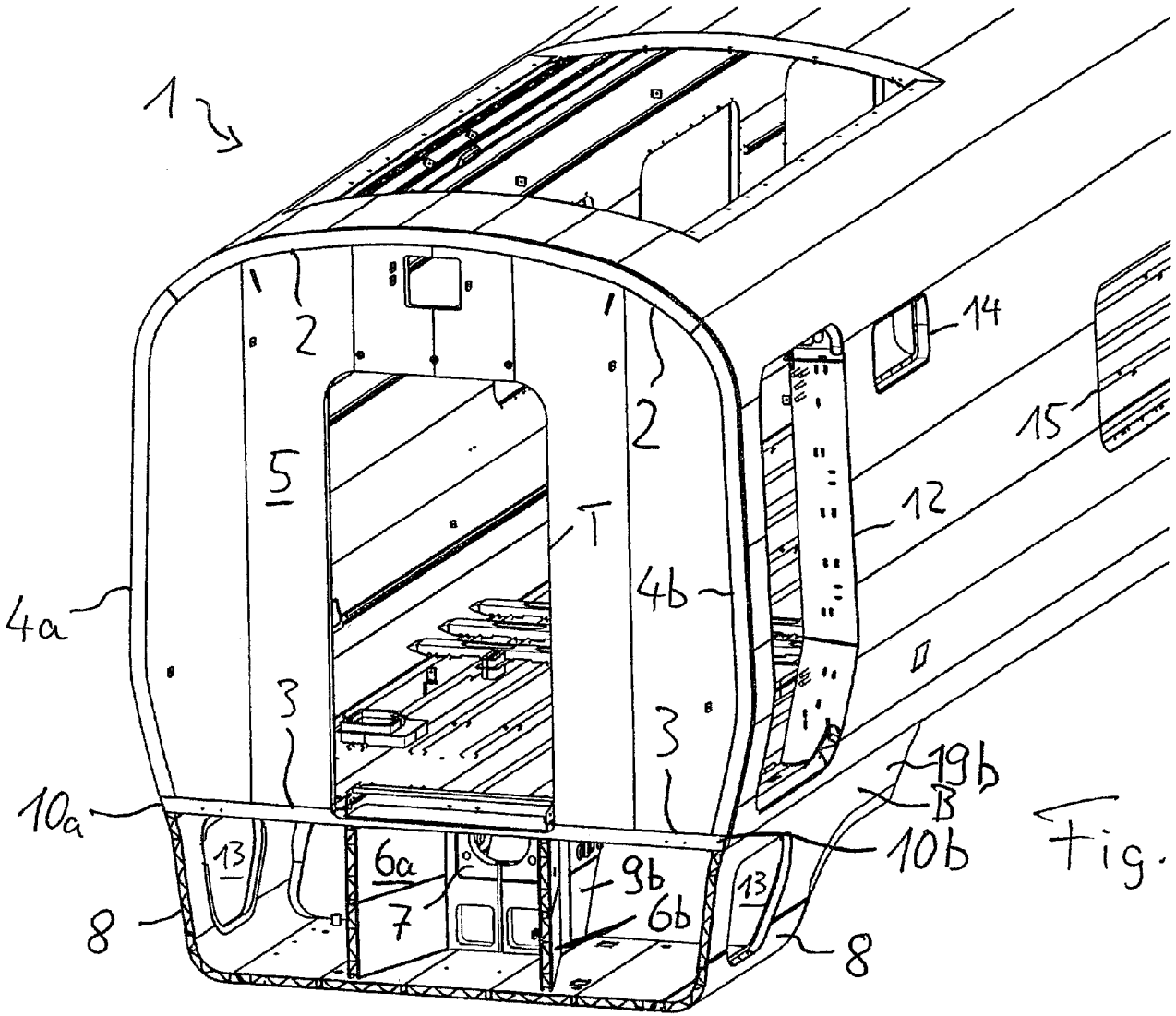
FIG. 1 a three dimensional view of an end face of a carriage body, wherein the carriage body is constructed in an integral manner and wherein a coupling plate is arranged in the end region of the carriage body under the base, the lower face of said coupling plate being joined directly to opposing lateral longitudinal supports via a connection, FIG. 2 a lateral view of the carriage body illustrated in FIG. 1, FIG. 3 a view of the lower portion of the carriage body end region of FIG. 1 and FIG. 2 in which the middle region of the connection has been omitted in order to show the lower face of the coupling plate with adjacent additional force transfer elements and wherein the carriage body end region is shown upside down, FIG. 4 a view similar to the one in FIG. 3 in which, however, the connection between the lower face of the coupling plate and the opposing longitudinal supports is shown in its entirety, FIG. 5 a view of the end region illustrated in FIG. 4 in the longitudinal direction of the carriage body, wherein the image plane of FIG. 5 is perpendicular to the longitudinal direction of the carriage body, FIG. 6 a view from below of the carriage body end region shown in FIGS. 3 through 5 in which, however, the connection of the lower face of the coupling plate to the lateral longitudinal supports has been omitted and in which the illustration only shows the area around the coupling plate and the additional force transfer elements connected thereto, FIG. 7 a blown-up view of a subarea of the illustration in FIG. 6, wherein the subarea is the connection zone between the coupling plate and two additional force transfer elements welded thereto, and FIG. 8 a cross-section through a portion of the arrangement illustrated in FIG. 7.

FIG. 1 shows a carriage body 1 for a railroad vehicle, in particular for a large capacity passenger coach. The view is directed to the end wall 5 of the carriage body 1, which has a central door opening T. Located on the end wall 5 are the end faces of the lateral walls 4*a*, 4*b*, which when viewed from the door opening T are opposite one another, the end face of the roof element 2, and the end face of a floor or a base 3. The carriage body 1 is shown in an unfinished state in which the construction has not yet been completed.

The carriage body 1 is constructed in an integral manner. The base 3 is configured as a base plate. The lateral walls 4*a*, 4*b* and the roof element 2 are each prefabricated as a single piece and joined to one another, in particular welded together, to produce the carriage body 1. The prefabricated modules 2, 3, 4 and optionally other components of the carriage body 1 as well are preferably aluminum extrusion press profiles in which are arranged air chambers between the aluminum sheets forming the outer surface of the respective module, said air chambers being separated from one another by partitions made of aluminum sheets. When viewing a cross-sectional profile, the partitions are oriented in the manner of a framework. The partitions are continuous in the longitudinal direction of the extruded modules, or at least over a longitudinal section thereof. The aforementioned modules 2, 3, 4 and also the other modules of the carriage body 1 produced by the extrusion press method can be assembled from sub-modules produced separately by the extrusion press method and, for example, welded together. The inner structure of the extruded press profiles can be discerned below in FIG. 1 and FIG. 5. In these figures the partitions are designated with the reference sign 31 and the air chambers are designated with the reference sign 30. It can also be discerned that the base 3 is composed of at least five adjacent sub-modules 35*a*, 35*b*, 36*a*, 36*b*, 37 extending in the longitudinal direction (perpendicular to the image plane of FIG. 5). These sub-modules 35, 36, 37 are welded to one another on their transitions 32. On the opposing lateral edges of the base plate 3, the latter is welded to the opposing (relative to the base plate 3) longitudinal supports 34*a*, 34*b*. The longitudinal supports 34 differ from most of the other sub-modules in that they exhibit a greater separation distance between the exterior sheets forming the opposing surfaces, have an angular cross-sectional profile, and in that preference is given to the thicknesses of the exterior sheets and of the partitions being greater than in the other sub-modules. The other sub-modules of the lateral walls 4*a*, 4*b* are not shown in FIG. 5.

However, the longitudinal supports may be configured in any other suitable manner, for instance as I profiles. This applies to more than just this illustrative embodiment. Also, the longitudinal supports can be integral regions of the base or on the bottom of the lateral walls rather than individual components. A common feature of all longitudinal supports, however, is that greater forces can be transferred in the longitudinal direction of the carriage body via these supports than via the other regions of the base and lateral walls.

Preference is given to all extrusion press being closed on their end faces by welding additional sheet metal strips thereon. In the figures, some of the extrusion press modules are shown without these sheet metal strips so as to reveal the inner structure of the profiles.

Figure 2:
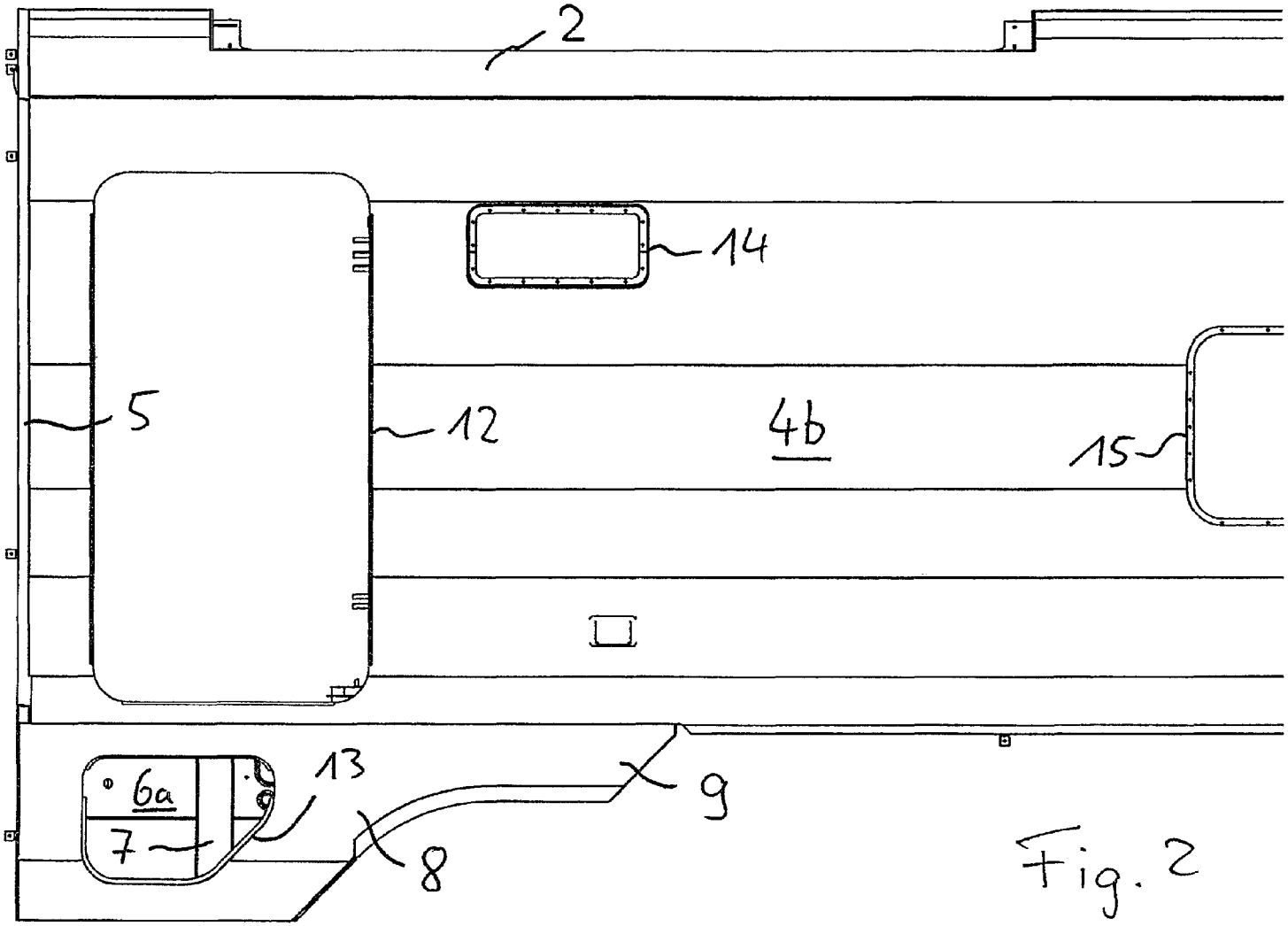

As shown in FIG. 1 and FIG. 2, the lateral wall 4*b* in the illustrated end region of the carriage body 1 has a door opening 12. The stability of the lateral wall 4*b* is therefore weakened. In FIG. 2, a portion of a window opening 15 can be discerned in the right of the drawing and another window cutout 14 can be discerned in the upper region of the lateral wall 4*b* next to the door cutout 12.

Figure 5:
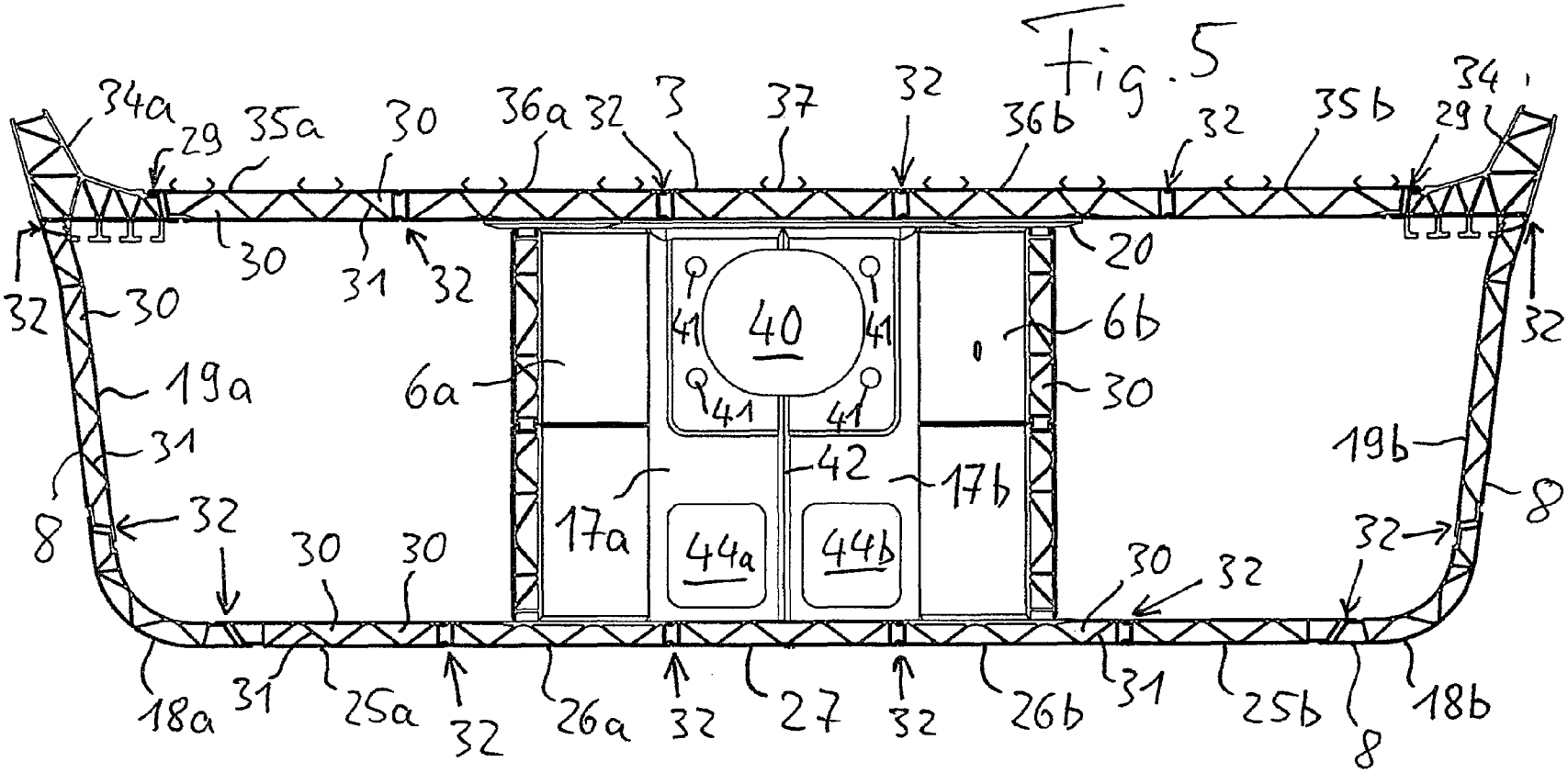

In FIG. 1, the transitional region between the base 3 and the lateral walls 4*a*, 4*b* is designated with the reference sign 10*a* and/or 10*b* on the opposing side. Located in these transitional regions are the longitudinal supports, which can be configured as shown in FIG. 5 and in the manner already described. However, other constructions are also possible. For instance, the longitudinal supports can be part of the base plate, as indicated in FIG. 1 by the continuous horizontal lines extending to the exterior of the carriage body, or the longitudinal supports can be joined to the base plate in the scope of a preliminary manufacturing process.

Before proceeding with the description of the construction of the coupling fixing device according to the example of embodiment illustrated in FIG. 1 through FIG. 7, it should be emphasized that other configurations of the carriage body 1 are possible in terms of the lateral walls, the base, the roof element, and also in terms of the production of the sub-modules or modules of the carriage body 1. For instance, the carriage body does not have to be a carriage body constructed in an integral manner. The material can also be something other than aluminum. Furthermore, provision can be made of other openings and openings in places other than those shown, for example, in FIG. 1 and FIG. 2.

The coupling fixing device in the example of embodiment is a coupling plate, specifically a coupling plate 7 manufactured from two parts 17*a*, 17*b* in the special example of embodiment. Preference is given to the coupling plate 7 not being an extrusion press profile with extruded hollow spaces. Instead the opposing surfaces, which are oriented in the longitudinal direction of the carriage body 1, are each formed from a solid piece of material with the exception of the bore holes 41 provided for the passage of fastening screws or fastening bolts for fixing the (not shown) coupling, said bore holes 41 being most readily discernible in FIG. 5, and with the exception of the other feed-through openings 40, 44*a*, 44*b*. The two parts 17*a*, 17*b* are welded together at their common transition 42. The parts 17 can in particular be made of aluminum.

Figure 3:
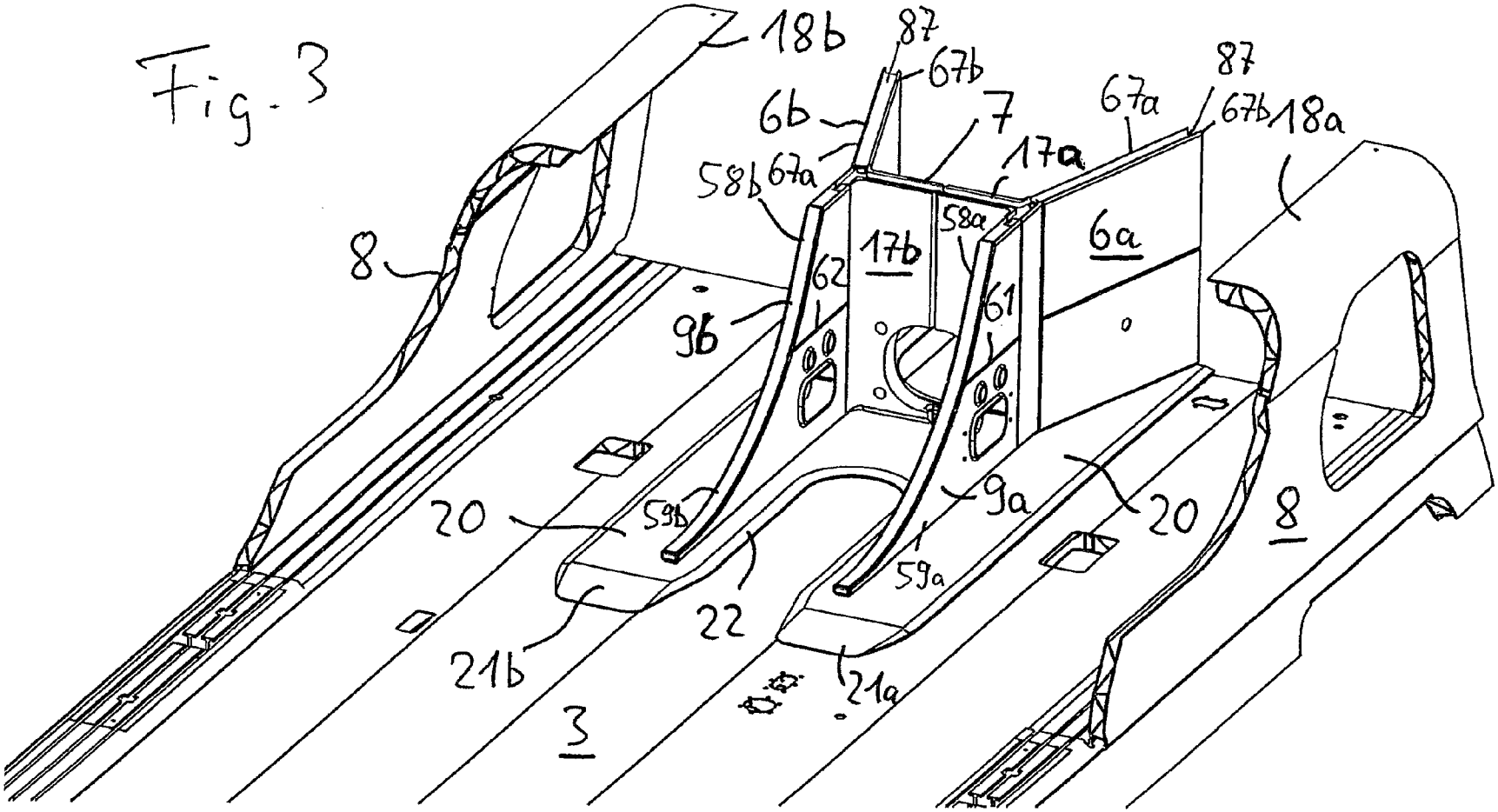

As is most readily discernible in FIG. 3, the upper face of the coupling plate 7, which is on the bottom of the coupling plate 7 due to the upside down representation of FIG. 3, is joined to the base 3 by a reinforcement plate 20. For example, the reinforcement plate 20 is first welded to the base 3 and then the coupling plate 7 is welded on its upper face to the reinforcement plate 20. Alternatively, the coupling plate 7 can be welded first to the other force transfer elements shown in FIG. 3 and to the additional force transfer elements 6*a*, 6*b*, 9*a*, 9*b* shown in other figures, and then this construction with an H-shaped horizontal cross-section can be welded on its upper face to the reinforcement plate 20. The H-shaped cross-sectional profile of this construction is most readily discernible in FIG. 6. This figure shows that the two parts 17*a*, 17*b* each have two angled regions 53, 54 (on part 17*a*) and 55, 56 (on part 17*b*) on their outside ends oriented to the lateral edge of the carriage body (top and bottom in FIG. 6). These angled regions 53, 54, 55, 56 are joined to the other force transfer elements as follows: the angled region 53 to the brace element 6*a*, the angled region 54 to a plate-shaped element 9*a* consisting of two parts 58*a*, 59*a* welded together, the angled region 55 to a second brace element 6*b*, and the angled region 56 to a second plate-shaped element 9*b* consisting of two parts 58*b*, 59*b* welded together. The brace elements 6*a*, 6*b* form a portion of the vertical legs of the H profile, wherein when viewed from the coupling plate 7 these parts of the vertical legs diverge, whereas the plate-shaped elements 9*a*, 9*b* run parallel to one another in the longitudinal direction of the carriage body. The brace elements 6*a*, 6*b* can also consist of two parts welded together, as indicated by a horizontal line on the brace element 6*a* in FIG. 3. The division of the plate-shaped elements 9*a*, 9*b* in the example of embodiment is likewise horizontal, as can likewise be most readily discerned in FIG. 3. The welded joint 61 of the two parts 58*a*, 59*a* is likewise represented by a horizontal line in FIG. 3, as is the welded joint 62 of the two parts 58*b*, 59*b* of the plate-shaped element 9*b*. The upper part 59*a*, 59*b* can have through-holes so as to allow the passage of, e.g., cables or lines.

Figure 6:
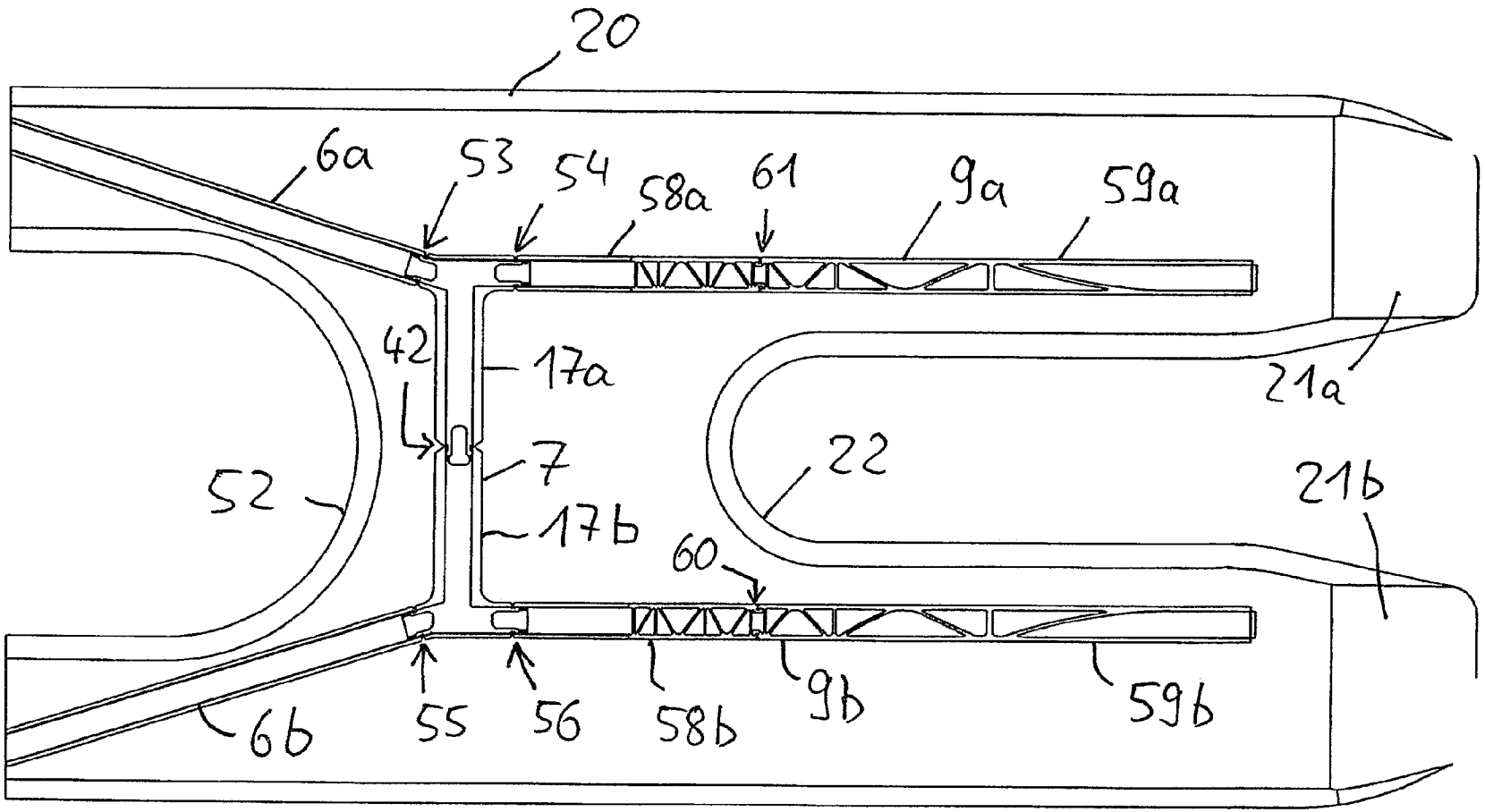

As FIG. 3 and FIG. 6 show, the reinforcement plate 20 also has an H-shaped profile in which, however, the transitions between the two vertical legs and the cross bar of the H profile are rounded. The corresponding rounded edges are designated with the reference signs 22 and 52 in FIG. 6. Furthermore, the end regions 21*a*, 21*b* of the vertical legs become thinner in terms of their material thickness, as measured in the vertical direction (perpendicular to the image plane of FIG. 6 and in the vertical direction in FIG. 3).

A particularly preferred way of producing the weld seams of the angled regions 53, 54, 55, 56 to the adjacent other force transfer elements 6*a*, 9*a*, 6*b*, 9*b* will now be explained with reference to FIG. 7, in which only the welded connections to the force transfer elements 6*a*, 9*a* are illustrated. The other two welded joints can be configured in the same manner. The angled regions 53, 54 of the part 17*a* of the coupling plate 7 have two tongue-shaped regions 74*a*, 74*b* on each of their free ends. In the following, only the area comprising the connection between the angled region 53 to the brace element 6*a* will be described in detail. The other transitional zone from the angled region 54 to the plate-shaped element 9*a* or to the upper part 58*a* thereof and to the lower part 59*a* thereof can be configured in the same manner. The tongue-shaped end sections 74*a*, 74*b* are spaced apart from one another and there is a hollow space 101 between them. In the extension of the tongue-shaped section 74*a*, 74*b* to the free end thereof, provision is made on the outside of a recess 73, which serves as a weld pool backing.

Figures 7, 8:
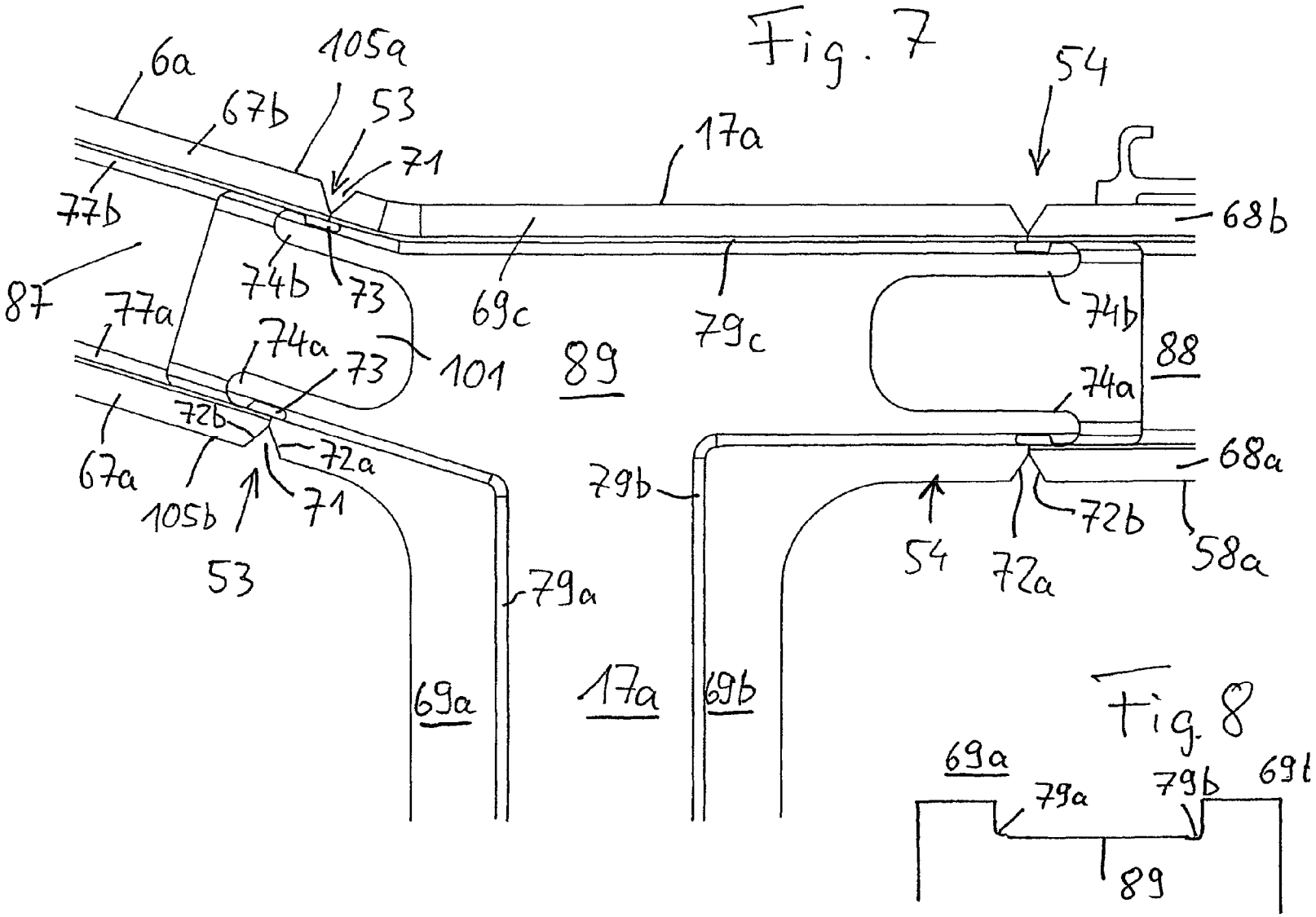

The end of the brace element 6*a* oriented toward the angled region 53 likewise has two protruding end sections 105*a*, 105*b* running parallel to one another such that a hollow space is also formed between the end sections 105, which is a part of the hollow space 101 in the assembled configuration illustrated in FIG. 7. In the assembled state the hollow space 101 is circumferentially bordered by the angled region 53 on one side and by the brace element 6*a* on the other side. The end sections of the angled region 53 and of the brace element 6*a* overlap, the tongue-shaped end sections 74*a*, 74*b* resting on the interior face of the protruding end sections 105*a*, 105*b*. The exterior recess 73 of the tongue-shaped end sections 74*a*, 74*b* extends toward the free end of said tongue-shaped end sections 74*a*, 74*b* over the joint region, on which the protruding end sections 105*a*, 105*b* of the brace element 6*a* come into abutment on the material of the angled region 53. On the outside at this joint region, the material of the brace element 6*a* as well as the material of the angled region 53 is beveled such that the resulting beveled surfaces 72*a*, 72*b* give rise to a V profile or a Y profile. A recess 71 accessible from the outside is thus formed inside the two legs of the Y or V profile. Like the previously described shape feature of the transitional region, this recess 71 extends in the vertical direction (perpendicular to the image plane of FIG. 7) over the entire end of the angled region 53 or of the brace element 6*a*. This also applies to the hollow space 101.

In the assembled state described in the preceding, the weld seam has not yet been produced. In a manner known per se, in each case it is now possible to produce a weld seam in the region of the V-shaped or Y-shaped recess 71. As a result two weld seams are formed in each transitional region between the coupling plate and the additional force transfer element. An advantage of the protruding end regions with the hollow space 101 between them resides in the fact that the material thicknesses of the parts in abutment with one another and to be welded together are approximately equal in the joint region such that the heat capacities are also approximately equal. When the materials are heated to produce a weld seam, the temperatures of the materials of the parts in abutment with one another are therefore approximately equal. Furthermore, a thermal equilibrium can be achieved by heat conduction due to the already existing material contact. Moreover, due to the inner tongue-shaped end sections the plugged-together end regions of the parts to be welded together are already in a provisionally fixed relative position, hence making it easier to produce the welded joint.

Alternatives to the embodiment shown in FIG. 7 are possible. On the one hand, the angled region 53 does not have to be bent at the angle shown in FIG. 7 relative to the part of the coupling plate illustrated below in FIG. 7. The angle may instead vary according to the desired construction. The same applies to the other angled region 54, which can also be omitted in another configuration of the coupling plate. It is likewise possible to omit the angled region 53, whereas the angled region 54 is retained. Furthermore, either both or just one of the tongue-like end sections can be provided on the other part (e.g., the brace element 6*a*), but not on the angled region. In particular it is also possible for one of the two parts to be joined together to have one tongue-shaped end section and for the other part to have the other tongue-shaped end section.

FIG. 3 and FIG. 7 show that the lower face of the coupling plate 7, of the brace elements 6*a*, 6*b*, and of the plate-shaped elements 9*a*, 9*b* illustrated in FIG. 3 above has a profiled rather than a continuously level surface. The purpose of this profiling is to adapt the thermal properties, in particular the effective heat capacity, of the aforementioned elements to the thermal properties of components to which the elements are to be welded or otherwise joined by heating. The upper face of the elements can be configured in the same manner. On the upper face the elements are welded to the reinforcement plate 20. The profiling causes the effective heat capacity to decrease. To this end, material is cut out on the lower end in the middle region of the surface. Only the edge regions of the surface, which are preferably configured as level and wherein the two opposing edge regions preferably end at the same height level, come into abutment with the part to which the element is to be welded or otherwise joined by heating. The middle region of the end surface of the part 17*a* of the coupling plate 7 is designated with the reference sign 89 in FIG. 7. The transition of the middle region 89 to the two opposing end regions 69*a*, 69*b* is designated with the reference signs 79*a*, 79*b*. These transitional regions can be configured as rounded, as indicated by parallel lines in FIG. 4. Because the part 17*a* in the example of embodiment illustrated in FIG. 7 has the two angled regions 53, 54 and thus a T-shaped cross-sectional profile, there is a third edge region 69*c*, the transitional zone of the middle recessed surface region 89 to the third edge region 69*c* being designated with the reference sign 79*c*.

Accordingly, the slot element 6*a* has a middle recessed surface region 87, on the opposing edges of which the edge regions 67*a*, 67*b* rest and wherein said edge regions rest on the adjacent part during the production of the connection thereto. The transitional regions are designated with the reference signs 77*a*, 77*b*. The middle recessed region of the end surface of the part 58*a* (FIG. 7, right) is designated with the reference sign 88, and the opposing end regions are designated with the reference signs 68*a*, 68*b*.

FIG. 8 shows a cross-section through the part 17*a* outside the angled regions 53, 54, wherein the image plane is perpendicular to the image plane of FIG. 7 and extends in the longitudinal direction of the carriage body, i.e., in the horizontal direction of the image plane in FIG. 7.

A preferred example of embodiment of a connection of the lower face of the coupling plate 7 to the opposing longitudinal supports 34*a*, 34*b* will now be described in the following. The connection 8 is configured in a continuous manner, from one of the longitudinal supports 34*a* to the other longitudinal support 34*b*, and has a trough-shaped cross-sectional profile (FIG. 5). The connection 8 is joined to each longitudinal support 34 by a welded joint 32. It is composed of a plurality of sub-modules (from left to right in FIG. 5) 19*a*, 18*a*, 25*a*, 26*a*, 27, 26*b*, 25*b*, 18*b*, and 19*b*, wherein these sub-modules are configured as plates and each connected to two adjacent parts via a weld seam 32. In a manner similar to that illustrated in FIG. 7 for the angled areas 53, 54, provision can be made of tongue-shaped end sections permitting a plugging together of the parts to be joined to one another prior to the actual welding, wherein said tongue-shaped sections have a weld pool backing and are configured such that the effective heat capacities of the parts to be joined together are similar or equal.

Two of the sub-modules, specifically the modules 18*a*, 18*b*, are curved in order to achieve the trough-shaped profile. They form the transition from the trough bottom to the lateral walls of the trough.

Figure 4:
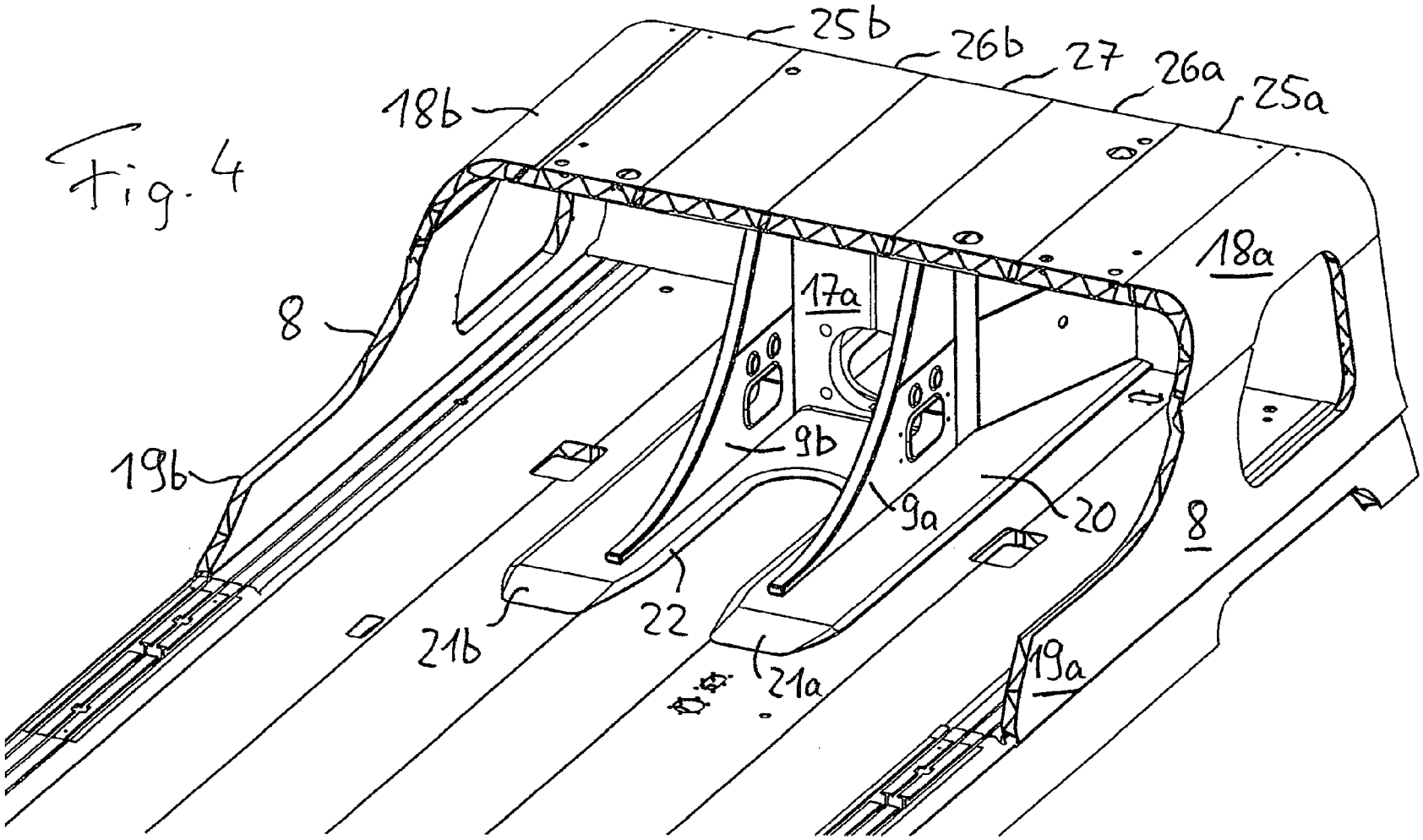

In the horizontal direction of the carriage body (perpendicular to the image plane of FIG. 5) the sub-modules 18*a*, 25*a*, 26*a*, 27, 26*b*, 25*b*, and 18*b* extend over a longitudinal section that is approximately equal to the longitudinal extension which the combination of the coupling plate 7 with the brace elements 6*a*, 6*b* fixed thereon as well as the plate-shaped elements 9*a*, 9*b* likewise fixed on the coupling plate 7 has. Reference is being made to the longitudinal extension on the lower face of the construction. It can be discerned from FIG. 3 that the longitudinal extension is greater on the upper face of the construction, since the plate-shaped elements 9*a*, 9*b* exhibit a curved contour on their lower edge. As indicated in FIG. 4, the longitudinal extension of the trough bottom of the connection 8 can also be somewhat greater than the longitudinal extension of the aforementioned construction, on the lower face thereof.

Ideally the connection 8 with a trough-shaped profile has an opening 13 on each of its lateral trough walls, as can be most readily discerned in FIG. 2 and FIG. 1. Alternatively or additionally, the longitudinal extension of the subarea or piece 19*a*, 19*b*, which is joined to the respective longitudinal support 34*a*, 34*b*, is much greater than the longitudinal extension on the trough bottom, i.e., on the bottom of the connection 8. This greater longitudinal extension is made possible by, for example, the protruding region B of the sub-module 19*b* illustrated in the bottom right of FIG. 1. The greater longitudinal extension, wherein the connection 8 contacts the longitudinal support 34 over the entire greater longitudinal extension, improves the stability and thus enables greater forces to be transferred in the longitudinal direction between the longitudinal support 34 and the connection 8.

As FIG. 5 shows, the brace elements 6*a*, 6*b* are joined on their lower face to the connection 8, in this case the sub-modules 26*a*, 26*b*. The plate-shaped elements 9*a*, 9*b* are also joined on their lower face to these sub-modules 26*a*, 26*b*. The coupling plate 7 itself is also joined to the connection 8, specifically to the central sub-module 27 and by its angled edge regions to the sub-modules 26*a*, 26*b*. All of these connections of the coupling plate 7, of the brace elements 6*a*, 6*b*, and of the plate-shaped elements 9*a*, 9*b* are preferably welded joints, wherein the lower face of the overhead construction illustrated in FIG. 3 is preferably configured as described with a recessed, receding surface region.

The arrangement of FIG. 1 and FIG. 5 beneath the carriage body base 3, which is open toward the end face, can be at least partially closed by plate-shaped elements (not shown). As mentioned above, the open ends of the modules can also be closed by welding on sheet metal strips.

Regardless of the precise configuration, the assembly of the carriage body base 3 together with the reinforcement plate 20, the coupling plate 7, the two brace elements 6*a*, 6*b*, and the middle region of the trough bottom of the connection 8 as defined above can be designated as a coupling box. On the end face, however, this coupling box is at least partially open so that the coupling can extend through the interior space of the coupling box to the coupling plate 7 and can be fixed thereon

The invention claimed is:

1. A carriage body for a railroad vehicle, comprising:

a floor, two lateral walls, which are each joined to the floor, at least two longitudinal supports, which are arranged on opposing sides of the carriage body in each transitional region of the floor to the lateral wall and extend in a longitudinal direction of the carriage body, a coupling fixing device for fixing a coupling via which the carriage body is hooked up to a carriage body of another carriage, wherein the fixing device is arranged beneath the floor, and wherein a lower face of the coupling fixing device is joined directly to the longitudinal supports via a connection, wherein the connection of the lower face of the coupling fixing device to the longitudinal supports on the opposing sides of the carriage body is continuous such that the lower face of the coupling fixing device and sections of the connection extending from the longitudinal supports to the lower face of the coupling fixing device form a trough-shaped profile in a cross-section running perpendicular to the longitudinal direction of the carriage body, wherein an interior space of the trough lies below the floor of the carriage body, wherein the coupling fixing device is held on the lower face of the floor of the carriage body on a side opposite the side of the carriage body end by at least one plate-shaped element.

2. The carriage body as in claim 1, wherein the coupling fixing device is a coupling plate and has, on an upper end that is connected to the floor of the carriage body, on a lower end that is joined via the connection to the longitudinal supports, or on the upper end that is connected to the floor of the carriage body and on the lower end that is joined via the connection to the longitudinal supports, a surface that has a receding region arranged between opposing edge regions of the surface such that a hollow space is left in the receding region between the coupling plate and the floor or the connection, and wherein the edge regions are joined to the floor or to the connection to the longitudinal supports via a joint connection that requires a heating of the parts to be joined together.

3. The carriage body as in claim 1, wherein the coupling fixing device is a coupling plate that has on each lateral end, when viewed in a horizontal cross-sectional area at the lateral ends in proximity to the opposing longitudinal supports of the carriage body, at least one angled region such that when viewed in the horizontal cross-sectional plane, the coupling plate forms a U-shaped profile or, if the lateral ends are angled on both sides, an H-shaped profile, and wherein the coupling plate is joined via the angled region to a force transfer element, via which forces can be transferred between the base of the carriage body and the coupling plate.

4. The carriage body as in claim 1, wherein the connection is produced by at least one plate-shaped part, wherein opposing outer surfaces of the plate-shaped part extend toward the connection and approximately in the longitudinal direction of the carriage body.

5. The carriage body as in claim 1, wherein the connection extends over a longitudinal section of the carriage body, in which the connection is joined in two places to the floor of the carriage body via a brace element running from bottom to top to the floor, wherein the two brace elements are spaced apart from one another in a horizontal direction running transversely to the longitudinal direction of the carriage body, and wherein the separation interval defines a space through which the coupling extends from the carriage body end to the coupling fixing device when the coupling is fixed on the coupling fixing device.

6. A railroad vehicle with a carriage body as in claim 1.

7. The carriage body as in claim 1, wherein the connection extends in the longitudinal direction of the carriage body over at least a length of the lower face of the coupling fixing device.

8. The carriage body as in claim 1, wherein the connection is made of at least one plate-shaped part.

9. The carriage body as in claim 8, wherein the plate-shaped part is an extruded part.

10. The carriage body as in claim 9, wherein the extrusion direction of the plate-shaped part is aligned with the longitudinal direction of the carriage body.

11. The carriage body as in claim 9, wherein the plate-shaped part is an extruded aluminum part.

12. The carriage body as in claim 1, wherein the connection is made of extruded aluminum box profiles.

13. A method for producing a carriage body for a railroad vehicle, comprising the steps of:

provision of a carriage body floor, provision of two lateral walls, arrangement of at least one longitudinal support in the transitional region of the floor to one of the lateral walls, wherein the longitudinal supports extend in a longitudinal direction of the carriage body, provision of a coupling fixing device for fixing a coupling via which the carriage body can be hooked up to a carriage body of another carriage, wherein the coupling fixing device is arranged beneath the floor, and joining of each lateral wall to the floor, wherein a lower face of the coupling fixing device is fixed directly to the longitudinal supports via a connection, and wherein the connection of the lower face of the coupling fixing device to the longitudinal supports on the opposing sides of the carriage body is configured as a continuous connection such that the lower face of the coupling fixing device and sections of the connection extending from the longitudinal supports to the lower face of the coupling fixing device form a trough-shaped profile in a cross-section running perpendicular to the longitudinal direction of the carriage body, wherein the interior space of the trough lies below the floor of the carriage body, wherein the coupling fixing device is held on the lower face of the floor of the carriage body on a side opposite the side of the carriage body end by at least one plate-shaped element.

14. The method as in claim 13, wherein provision is made of a coupling plate as a coupling fixing device, wherein the coupling plate is joined on an upper end to the floor of the carriage body and joined on a lower end via a connection to the longitudinal supports, wherein the coupling plate, on the upper end, on the lower end, or the upper end and the lower end, is configured such that the coupling plate has a surface in which a receding region is arranged between opposing edges of the surface such that a hollow space is left in the receding region between the coupling plate and the floor or the connection, and wherein the edge regions are joined to the floor or to the connection by a joint connection that requires a heating of the parts to be joined together.

15. The method as in claim 13, wherein provision is made of a coupling plate as a coupling fixing device, which has on each lateral end, when viewed in a horizontal cross-sectional area on the ends in proximity to the opposing longitudinal supports of the carriage body, at least one angled region such that, when viewed in the horizontal cross-sectional plane, the coupling plate forms a U-shaped profile or, if the lateral ends are angled on both sides, an H-shaped profile, and wherein the coupling plate is joined via the angled region to a force transfer element, which is joined to the floor of the carriage body such that forces can be transferred by the coupling plate via the force transfer element and by the force transfer element via the coupling plate between the floor of the carriage body and the coupling plate.

16. The method as in claim 13, wherein the connection is produced by at least one plate-shaped part, wherein opposing outer surfaces of the plate-shaped part extend toward the connection and approximately in the longitudinal direction of the carriage body.

17. The method as in claim 13, wherein the connection is produced over a longitudinal section of the carriage body, wherein the connection is joined in two places in the longitudinal section to the floor of the carriage body by a brace element running from bottom to top to the floor, wherein the two brace elements are arranged at a distance from one another in a horizontal direction running transversely to the longitudinal direction of the carriage body, and wherein the separation interval defines a space through which the coupling extends from the carriage body end to the coupling fixing device when the coupling is fixed onto the coupling fixing device.

18. The method as in claim 13, wherein the connection extends in the longitudinal direction of the carriage body over at least a length of the lower face of the coupling fixing device.

19. The method as in claim 13, wherein the connection is made of at least one plate-shaped part.

20. The method as in claim 19, wherein the plate-shaped part is an extruded part.

21. The method as in claim 20, wherein the plate-shaped part is an extruded aluminum part.

22. The method as in claim 19, wherein the extrusion direction of the at least one plate-shaped part is aligned with the longitudinal direction of the carriage body.

23. The method as in claim 13, wherein the connection is made of extruded aluminum box profiles.

* * * * *